US010694877B2

(12) United States Patent
Kroeker

(10) Patent No.: US 10,694,877 B2
(45) Date of Patent: Jun. 30, 2020

(54) DOUBLE REACHER APPARATUS

(71) Applicant: Bradlee Kroeker, Mesa, AZ (US)

(72) Inventor: Bradlee Kroeker, Mesa, AZ (US)

( * ) Notice: Subject to any disclaimer, the term of this patent is extended or adjusted under 35 U.S.C. 154(b) by 61 days.

(21) Appl. No.: 16/140,493

(22) Filed: Sep. 24, 2018

(65) Prior Publication Data

US 2020/0093308 A1 Mar. 26, 2020

(51) Int. Cl.
*A47G 25/90* (2006.01)

(52) U.S. Cl.
CPC ..... *A47G 25/90* (2013.01); *A47G 25/905* (2013.01)

(58) Field of Classification Search
CPC .... A47G 25/90; A47G 25/901; A47G 25/905; A47G 25/907; A47G 25/908; A47G 25/80; A47G 25/86; B25J 1/00; B25J 1/02; B25J 1/04; B25J 1/06; B25B 9/00; A47F 13/06
See application file for complete search history.

(56) References Cited

U.S. PATENT DOCUMENTS 881,163 A * 3/1908 Spiess
8,258,796 B2 * 9/2012 Lai ..... H04M 1/24 324/426
2002/0139819 A1 * 10/2002 Ferraioli ..... A47G 25/905 223/111
2010/0258600 A1 * 10/2010 Pfistor ..... A47G 25/90 223/111
2011/0315724 A1 * 12/2011 Whitlaw ..... A47G 25/90 223/111

FOREIGN PATENT DOCUMENTS

JP 20070292139 A * 2/2007
WO WO 2015073862 A1 * 5/2015

* cited by examiner

*Primary Examiner* — Ismael Izaguirre
(74) *Attorney, Agent, or Firm* — McLean Law LLC; Kimberly McLean, Esq.

(57) ABSTRACT

A double reacher apparatus to aid in donning a garment including an elongated handle member, a pair of parallel positioned arm members forming a U shape and a pair of clamp members. The elongated handle member is integrally connected to the pair of parallel positioned arm members. The pair of parallel positioned arm members are integrally coupled at a distal end of the elongated handle along a U-bend region and the pair of parallel positioned arm members have an adjustable width therebetween along the U-bend region. The width being adjusted to a length so as to extend open an attached garment wide enough to allow a user to insert both legs contemporaneously into the garment. The pair of clamp members operatively grip and ungrip a garment. Each clamp member is integrally connected to a distal end of a corresponding arm member and each clamp member has a fixed engaging member which attaches directly to the corresponding arm member and a movable mating engaging member which is integrally connected to the fixed engaging member.

11 Claims, 2 Drawing Sheets

DOUBLE REACHER APPARATUS

FIELD OF THE INVENTION

Embodiments described herein generally relate to dressing aids, and more particularly to a reacher apparatus to aid in donning a garment.

BACKGROUND OF THE INVENTION

Many individuals, due to physical challenges, have limited mobility and flexibility. Individuals may suffer physical challenges from old age, military injuries, surgery, accidents, etc. For many of the individuals with physical challenges it is difficult to put on lower body garments, such as, pants, shorts, underwear etc. Thus, an aid may be necessary to assist these individuals with donning lower body garments. Since, the individual may not be able to bend over, it would be beneficial to allow the individual to be able to insert both of his/her legs into lower body garments at the same time for mere ease of use to minimize any discomfort in putting on lower body garments. Therefore, an aid is needed that is long enough to prevent the individual from having to bend over too much and that allows the individual to insert both legs into the garment at the same time.

BRIEF DESCRIPTION OF THE DRAWINGS

The various advantages of the embodiments of the present disclosure will become apparent to one skilled in the art by reading the following specification and appended claims, and by referencing the following drawings, in which:

SUMMARY OF THE INVENTION

Figure 1:
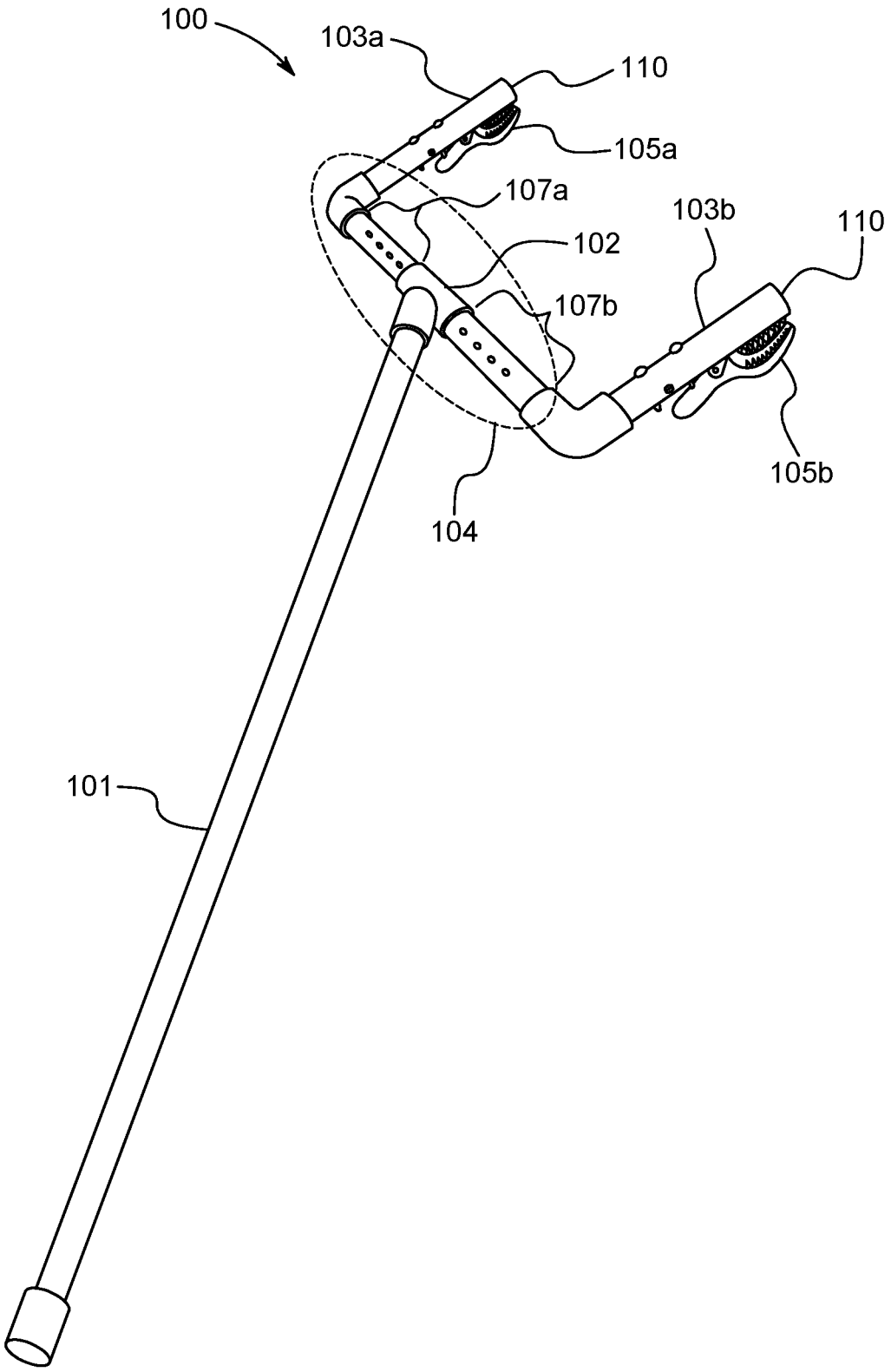
FIG. 1 shows an exemplary reacher apparatus according to an embodiment of the present disclosure.

Exemplary embodiments disclosed herein describe a reacher apparatus to aid in donning a garment. The reacher apparatus has an elongated handle member integrally connected to a pair of parallel positioned arm members forming a U shape and a pair of clamp members. The pair of parallel positioned arm members are integrally coupled at a distal end of the elongated handle along a U-bend region. The coupled pair of parallel positioned arm members have an adjustable width therebetween along the U-bend region, the width being adjusted to a length so as to extend open an attached garment wide enough to allow a user to insert both legs contemporaneously into the garment. The pair of clamp members operatively grip and ungrip a garment. Each clamp member has a fixed engaging member attached directly to a corresponding arm member and a movable mating engaging member integrally connected to the fixed engaging member.

In some exemplary embodiments, the pair of parallel positioned arm members are integrally coupled such that one arm member fits into the other arm member.

In some exemplary embodiments the pair of parallel positioned arm members each include a plurality of apertures along the U-bend region, the plurality of apertures designates width markers along the U-bend region. The width markers represent alternative positions to which a corresponding arm member can be moved to adjust the width of the corresponding arm member.

In some exemplary embodiments, the width between the pair of parallel positioned arm members is adjusted by moving the arms members to alternative positions along the U-bend region.

In some exemplary embodiments, a fastener is attached to each arm member to hold the alternative position to which a corresponding arm member moved.

In some exemplary embodiments, the fixed engaging member and the movable mating engaging member are jaw structures, each with a set of teeth for gripping the garment.

In some exemplary embodiments, the movable mating engaging member includes a hand grip.

In some exemplary embodiments, the hand grip member is coupled to a corresponding arm member by a fastener.

In some exemplary embodiments, the pair of clamp members are each a jaw spring clamp.

In some exemplary embodiments, the reacher apparatus includes a trigger mechanism to open the pair of clamp members to grip a garment.

In some exemplary embodiments, each hand grip member operates to manually open a corresponding clamp member and the trigger mechanism operates to automate opening of the clamp members.

In some exemplary embodiments, the elongated handle is thirty-six inches long.

DETAILED DESCRIPTION

The present disclosure relates to a reacher apparatus to aid in donning a garment. The reacher apparatus is a double reacher including a long handle, an adjustable pair of arms and a pair of clamps. The double reacher allows a user to attach a garment to the pair of clamps and extend the garment wide open by adjusting the width of the pair of arms to the full width of the garment completely extended open. The long handle lets the user hold the garment out in front of him/her, without having to bend much, to allow the insertion of his/her legs into the garment simultaneously. The reacher enables users with limited mobility to be able to don their pants or other lower body garments without bending extensively.

Figure 2:
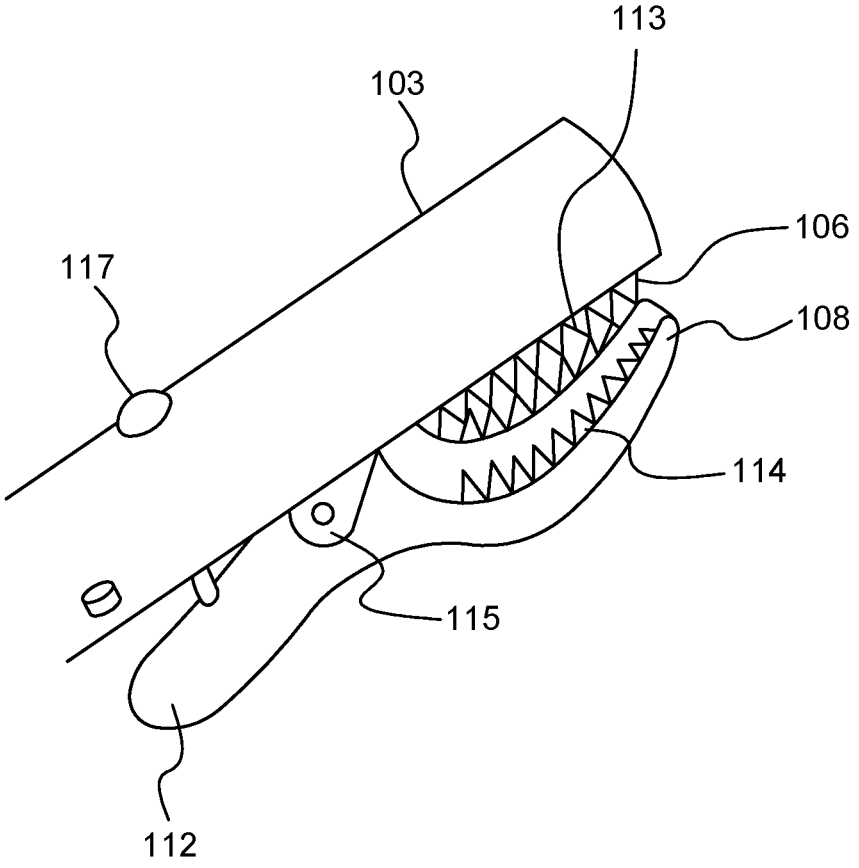
FIG. 2 shows an exemplary view of a clamp member attached to an arm member of the reacher apparatus according to an embodiment of the present disclosure.

As illustrated in FIGS. 1-2, an exemplary reacher apparatus includes a handle member 101, a pair of parallel positioned arm members 103 *a* and 103 *b*, and a pair of clamp members 105 *a* and 105 *b*. The handle member is elongated having an approximate length of thirty-six (36) inches and is integrally connected to the pair of arm members at a distal end 102 of handle member. The handle member and arm members are made of tubing/piping. The tubing/piping can be made of any suitable material, such as, for example, polyvinyl chloride (PVC), plastic, powder-coated aluminum, nylon, etc. The handle and arm members are interconnected as shown in FIG. 1 using any suitable connector for the type of material(s) used in the construction of the handle and arm members, such as, for example, PVC connectors. Although in a preferred embodiment the handle is described as having a length of thirty six (36) inches, the length of the handle can be constructed as any suitable length.

The pair of arm members 103 *a* and 103 *b* are positioned parallel to one another, forming a U shape having a U-bend region 104. The arm members are integrally coupled to one another at the distal end 102 of handle member 101 using any suitable coupling mechanism. In a preferred embodiment, the arm members are integrally coupled such that one arm member is able to fit into the other arm member. This will allow a user to adjust the width (i.e., widen or narrow)

between the arm members along the U-bend region based on a friction (i.e., push or pull friction) applied to the U-bend region. When the arm members are pushed inward (i.e., in the direction towards one another) the width is narrowed and one arm member will slide into the other arm member a distance according to width markers. When the arm members are pulled outward (i.e., in the direction away from one another), the width is widened and the arm members will slide out from one another a distance according to width markers.

The arm members 103 *a* and 103 *b* each have a plurality of apertures 107 *a* and 107 *b* along the U-bend region 104. The plurality of apertures designates width markers which each represent alternative positions to which a corresponding arm member can be moved to adjust the width. The width markers allow a user to adjust the width between the arm members along the U-bend region to a length approximately equal to the length of a garment when the garment is extended wide open. This will allow the user to fully open the garment so that the user can insert both of his/her legs simultaneously into the garment.

In FIG. 1, the illustrated width between arm members 103 *a* and 103 *b*, in the U-bend region 104, is fully extended. If a user wants to narrow the width, for example, the user may push both arm members inwards (i.e., moving the arm members to alternative positions) such that the number of visible width markers is reduced. Alternatively, for example, if the width is not fully extended and the user wants to widen the width, the user may pull the arm members outwards (i.e., moving the arm members to alternative positions) such that the number of visible width markers increases.

In an alternative embodiment, a fastener (not shown) may be attached to each arm member 103 *a* and 103 *b* to hold the corresponding arm member at the alternative position to which the arm member moved.

Each arm member 103 *a* and 103 *b* has a corresponding clamp member 105 *a* and 105 *b* integrally connected thereto at a distal end 110. The pair of clamp members operatively grip and ungrip a garment. As shown in FIG. 2, each clamp member has a fixed engaging member 106 and a movable mating engaging member 108, both engaging members operate to collectively engage a garment to grip the garment and to collectively disengage a garment to ungrip the garment.

The fixed engaging member 106 is attached directly to the corresponding arm member 103. In a preferred embodiment, the fixed engaging member is built into the structure of the corresponding arm member. In an alternative embodiment, the fixed engaging member may be connected to the arm member using any suitable connector or fastener.

The movable mating engaging member 108 integrally connects to the fixed engaging member 106 using any suitable connectors, fasteners, etc. In a preferred embodiment, the movable mating engaging member connects to the fixed engaging member using a spring.

The movable mating engaging member 108 has a hand grip member 112 for manually opening the corresponding clamp member 103. Moreover, the hand grip member is coupled to a corresponding arm member 103 by a fastener 117.

In another exemplary embodiment clamp members 105 *a* and 105 *b* are each of a jaw spring clamp type, wherein fixed engaging member 106 and movable mating engaging member 108 are both jaw engaging structures, each including a plurality of teeth 113 and 114 respectively for engaging a garment. The jaw engaging structures are interconnected by a spring mechanism 115.

In another exemplary embodiment, the reacher apparatus 100 includes a trigger mechanism (not shown) which automates the opening of clamp members 105 *a* and 105 *b*, for example, to grip a garment. This feature allows the user to grab items that are not in reach of the user, such as, for example, garments on the floor.

Accordingly, while example embodiments are capable of various modifications and alternative forms, embodiments thereof are shown by way of example in the figures and will herein be described in detail. It should be understood, however, that there is no intent to limit example embodiments to the particular forms disclosed, but on the contrary, example embodiments are to cover all modifications, equivalents, and alternatives falling within the scope of the disclosure. Like numbers refer to like/similar elements throughout the detailed description.

It is understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between," "adjacent" versus "directly adjacent," etc.)

The terminology used herein is for the purpose of describing particular embodiments only and is not intended to be limiting of example embodiments. As used herein, the singular forms "a," "an" and "the" are intended to include the plural forms as well, unless the context clearly indicates otherwise. It will be further understood that the terms "comprises," "comprising," "includes" and/or "including," when used herein, specify the presence of stated features, integers, steps, operations, elements and/or components, but do not preclude the presence or addition of one or more other features, integers, steps, operations, elements, components and/or groups thereof.

Unless otherwise defined, all terms (including technical and scientific terms) used herein have the same meaning as commonly understood by one of ordinary skill in the art to which example embodiments belong. It will be further understood that terms, e.g., those defined in commonly used dictionaries, should be interpreted as having a meaning that is consistent with their meaning in the context of the relevant art. However, should the present disclosure give a specific meaning to a term deviating from a meaning commonly understood by one of ordinary skill, this meaning is to be taken into account in the specific context this definition is given herein.

The disclosed embodiments are not inclusive and many other modifications and variations will be apparent to someone of ordinary skill in the art with construction skills in the related arts. Together the descriptions and accompanying illustrations seek to provide an explanation of the basic principles of the embodiment and its application. It is therefore intended that the specification and embodiments be considered as exemplary only.

Those skilled in the art will appreciate from the foregoing description that the broad techniques of the embodiments of the present invention may be implemented in a variety of forms. Therefore, while the embodiments of this invention have been described in connection with particular examples thereof, the true scope of the embodiments of the invention should not be so limited since other modifications will become apparent to the skilled practitioner upon a study of the drawings, specification, and following claims.

What is claimed is:

1. A reacher apparatus to aid in donning a garment, the apparatus comprising:

an elongated handle member integrally connected to a pair of parallel positioned arm members forming a U shape, wherein the pair of parallel positioned arm members are integrally coupled at a distal end of the elongated handle along a U-bend region and the pair of parallel positioned arm members each include a plurality of apertures along the U-bend region;

the coupled pair of parallel positioned arm members having an adjustable width therebetween along the U-bend region, the width being adjusted to a length so as to extend open an attached garment wide enough to allow a user to insert both legs contemporaneously into the garment; and a pair of clamp members to operatively grip and ungrip the garment, each clamp member integrally connected to a distal end of a corresponding arm member, each clamp member having a fixed engaging member attached directly to the corresponding arm member and a movable mating engaging member integrally connected to the fixed engaging member.

2. The apparatus of claim 1, wherein the pair of parallel positioned arm members are integrally coupled such that one arm member fits into the other arm member.

3. The apparatus of claim 1, wherein the plurality of apertures designates width markers along the U-bend region, the width markers represent alternative positions to which a corresponding arm member can be moved to adjust the width of the corresponding arm member.

4. The apparatus of claim 3, wherein the width between the pair of parallel positioned arm members is adjusted by moving the arms members to alternative positions along the U-bend region.

5. The apparatus of claim 4, wherein a fastener is attached to each arm member to hold the alternative position to which a corresponding arm member moved.

6. The apparatus of claim 1, wherein the fixed engaging member and the movable mating engaging member are jaw structures, each with a set of teeth for gripping the garment.

7. The apparatus of claim 1, wherein the movable mating engaging member includes a hand grip member.

8. The apparatus of claim 7, wherein the hand grip member is coupled to a corresponding arm member by a fastener.

9. The apparatus of claim 1, wherein the pair of clamp members are each a jaw spring clamp.

10. The apparatus of claim 7 wherein the hand grip member operates to manually open a corresponding clamp member.

11. The apparatus of claim 1, wherein the elongated handle is thirty six inches long.

* * * * *